US009333777B2

(12) United States Patent
Block et al.

(10) Patent No.: US 9,333,777 B2
(45) Date of Patent: May 10, 2016

(54) LABEL PRINTER

(71) Applicant: Esselte IPR AB, Solna (SE)

(72) Inventors: David Block, El Cerrito, CA (US); Matthew M. Taylor, Mountain View, CA (US); J. G. Goldberg, Menlo Park, CA (US); Robert A. Riccomini, Saratoga, CA (US); Hardy S. Shen, San Jose, CA (US); Dan Harden, Pal Alto, CA (US); Chris Whittall, Los Gatos, CA (US); Ariel D. Turgel, San Francisco, CA (US); Zachary G. Stephanchick, San Jose, CA (US)

(73) Assignee: Esselte IPR AB (SE)

( * ) Notice: Subject to any disclaimer, the term of this patent is extended or adjusted under 35 U.S.C. 154(b) by 0 days.

(21) Appl. No.: 14/333,356

(22) Filed: Jul. 16, 2014

(65) Prior Publication Data

US 2015/0022612 A1 Jan. 22, 2015

Related U.S. Application Data

(60) Provisional application No. 61/846,926, filed on Jul. 16, 2013, provisional application No. 61/846,931, filed on Jul. 16, 2013.

(51) Int. Cl.
*B41J 2/00* (2006.01)
*B41J 15/04* (2006.01)

(52) U.S. Cl.
CPC ..... *B41J 15/044* (2013.01)

(58) Field of Classification Search
CPC ..... B41J 2/0057; B41J 3/4076; B41J 25/308; B41J 25/3088; B41J 29/393
USPC ..... 347/110
See application file for complete search history.

(56) References Cited

U.S. PATENT DOCUMENTS

| | | | |
|---|---|---|---|
| D216,281 | S | 12/1969 | Moyroud |
| 4,239,404 | A | 12/1980 | DeFilipps et al. |
| 4,439,257 | A | 3/1984 | Sato et al. |
| D275,966 | S | 10/1984 | Worrell |
| 4,535,463 | A | 8/1985 | Ito et al. |
| 4,591,404 | A | 5/1986 | Hamisch, Jr. |
| 4,623,418 | A | 11/1986 | Gombrich et al. |

(Continued)

FOREIGN PATENT DOCUMENTS

| | | |
|---|---|---|
| CN | 301199988 | 5/2010 |
| EP | 0297567 A2 | 1/1989 |

(Continued)

OTHER PUBLICATIONS

Baxter, R., (Dec. 1985) "Bar coding pays off for case", Production Engineer, *Journal of the Institution of Production Engineers*, vol. 64, No. 11, pp. 15-17.
Brother Corporation, "Internet Archive: Wayback Machine", Brother at your side, P-Touch Products (2 pages).
Brother Corporation, "P-Touch 9200DX (Model: PT-9200DX): Quick Reference" (40 pages).
Brother Corporation, "P-Touch Editor Version 3.1", Basic Operation, Reference and Index, (203 pages).
Casio Computer Co., Ltd., (2002) "TDK LPCW-50 CD/DVD label printer application version 1.0 for Windows User's Guide", (85 pages).

(Continued)

*Primary Examiner* — Manish S Shah
*Assistant Examiner* — Yaovi Ameh
(74) *Attorney, Agent, or Firm* — Goodwin Procter LLP

(57) ABSTRACT

A label printer includes a receiving area configured for receiving a cartridge that includes a roll of media for printing labels thereon, the receiving area also including features for aligning a plurality of differently sized cartridges with a printing mechanism; and components configured for adjusting label sizing to provide virtual label sizes.

35 Claims, 5 Drawing Sheets

(56) References Cited

U.S. PATENT DOCUMENTS 4,690,344 A 9/1987 Yokota
4,712,929 A 12/1987 Kitaoka
4,718,784 A 1/1988 Drisko
D295,535 S 5/1988 Reinke
4,765,765 A 8/1988 Futakata
4,797,018 A 1/1989 Hofmann et al.
4,807,177 A 2/1989 Ward
4,823,953 A 4/1989 Anderson et al.
4,838,713 A 6/1989 Kunimitsu et al.
4,911,566 A 3/1990 Imaseki et al.
4,918,464 A 4/1990 Isshiki
4,937,628 A 6/1990 Cipolla et al.
4,994,853 A 2/1991 Fukuchi et al.
5,014,073 A 5/1991 Sone et al.
5,025,397 A 6/1991 Suzuki
5,078,523 A 1/1992 McGourty et al.
5,087,979 A 2/1992 Schaertel
5,159,681 A 10/1992 Beck et al.
5,169,249 A 12/1992 Kitabata
5,176,458 A 1/1993 Wirth
5,181,787 A 1/1993 Hosomi
5,247,325 A 9/1993 Takahashi
5,253,334 A 10/1993 Kimura et al.
5,265,966 A 11/1993 Schmidt
5,266,972 A 11/1993 Gotho et al.
5,269,612 A 12/1993 Shimoha et al.
5,276,461 A 1/1994 Saito
5,297,876 A 3/1994 Imagawa
5,314,256 A 5/1994 Niwa
5,318,370 A 6/1994 Nehowig
5,322,375 A 6/1994 Niwa et al.
5,322,378 A 6/1994 Ikeda et al.
5,344,247 A 9/1994 Sakuragi et al.
5,362,008 A * 11/1994 Nagel et al. ..... 242/417
5,399,030 A 3/1995 Niwa et al.
5,424,757 A 6/1995 Thom
5,483,623 A 1/1996 Nagashima
5,488,223 A 1/1996 Austin et al.
5,489,971 A 2/1996 Nam
5,492,420 A 2/1996 Nunokawa et al.
5,521,627 A 5/1996 Keung et al.
5,559,934 A 9/1996 Ogura et al.
5,585,941 A 12/1996 Maemura
5,598,279 A 1/1997 Ishii et al.
5,605,404 A 2/1997 Nunokawa et al.
5,621,864 A 4/1997 Benade et al.
5,643,395 A 7/1997 Hinton
5,658,083 A 8/1997 Day et al.
5,677,999 A 10/1997 Hidaka et al.
5,680,223 A 10/1997 Cooper et al.
5,715,379 A 2/1998 Pavlovic et al.
5,721,813 A 2/1998 Leinhos
5,731,879 A 3/1998 Maniwa et al.
5,758,039 A 5/1998 Shibata et al.
5,760,814 A 6/1998 Kang
5,806,993 A 9/1998 Petterutti et al.
5,816,717 A 10/1998 Beadman et al.
5,823,689 A 10/1998 Nehowig et al.
5,823,693 A 10/1998 Henderson et al.
5,826,995 A 10/1998 Day et al.
5,864,652 A 1/1999 Murahashi
D407,751 S 4/1999 Zimmermann
5,892,892 A 4/1999 Popat et al.
5,895,157 A 4/1999 Morimura et al.
5,911,380 A 6/1999 Shiba
5,918,898 A 7/1999 Wallner et al.
5,918,989 A 7/1999 Stout, Jr. et al.
5,995,774 A 11/1999 Applegate et al.
6,016,386 A 1/2000 Nosaki et al.
6,059,469 A 5/2000 Hirumi
6,089,765 A 7/2000 Mori
6,106,170 A 8/2000 Watanabe et al.
6,152,623 A 11/2000 Palmer et al.
6,271,989 B1 8/2001 Tannert
6,281,989 B1 8/2001 Tomida
6,322,067 B1 11/2001 Fujii et al.
6,364,552 B1 4/2002 Nehowig et al.
6,367,992 B1 4/2002 Aruga et al.
6,425,700 B1 7/2002 Silverbrook et al.
D466,150 S 11/2002 Matsumoto et al.
6,503,005 B1 1/2003 Cockerill et al.
6,565,181 B2 5/2003 Silverbrook
6,609,844 B1 * 8/2003 Petteruti et al. ..... 400/88
D481,414 S 10/2003 Milton et al.
6,702,417 B2 3/2004 Silverbrook
6,812,943 B1 11/2004 Day et al.
6,835,013 B2 12/2004 Dunn et al.
6,857,801 B2 2/2005 Van Bever
6,890,113 B2 5/2005 Block
D507,523 S 7/2005 Resch et al.
6,954,254 B2 10/2005 Silverbrook
7,044,589 B2 5/2006 Silverbrook
7,066,588 B2 6/2006 Silverbrook et al.
7,077,515 B2 7/2006 Silverbrook
7,140,791 B2 11/2006 Van Bever
D533,831 S 12/2006 Kim
D538,333 S 3/2007 Nakajima et al.
D575,729 S 8/2008 Nomi et al.
D581,943 S 12/2008 Pedersen et al.
7,470,014 B2 12/2008 Silverbrook et al.
D594,504 S 6/2009 Hattori
D610,607 S 2/2010 Kachi et al.
7,722,172 B2 5/2010 Silverbrook
7,789,501 B2 9/2010 Silverbrook
D632,648 S 2/2011 Yang
D636,813 S 4/2011 Kikuchi et al.
D637,552 S 5/2011 Inman et al.
D640,735 S 6/2011 Kimura et al.
D643,807 S 8/2011 Jiang
7,990,567 B2 8/2011 Vleurinck et al.
D648,676 S 11/2011 Brookshire et al.
D656,537 S 3/2012 Van Den Broecke et al.
D659,186 S 5/2012 Okamoto et al.
D659,751 S 5/2012 Okamoto et al.
D660,787 S 5/2012 Lambert et al.
D661,344 S 6/2012 Okamoto et al.
D663,767 S 7/2012 Inada
D669,427 S 10/2012 Ignor et al.
D675,254 S 1/2013 Kubota et al.
D675,255 S 1/2013 Kubota et al.
D678,188 S 3/2013 Sasada
D682,777 S 5/2013 Gupta et al.
8,469,507 B2 6/2013 Fukui
D686,152 S 7/2013 Lee et al.
D694,319 S 11/2013 Nakagawa
D694,817 S 12/2013 Adam et al.
D697,865 S 1/2014 Saito et al.
D699,177 S 2/2014 Higashi
D701,898 S 4/2014 Nakata et al.
D705,719 S 5/2014 Wong
D706,341 S 6/2014 Kano et al.
D708,129 S 7/2014 Houghton et al.
D709,823 S 7/2014 Corley et al.
D712,457 S 9/2014 Koshimori et al.
D715,356 S 10/2014 Nakagawa et al.
D717,243 S 11/2014 Liu et al.
D719,086 S 12/2014 Lee et al.
D720,687 S 1/2015 Hasbrook
D721,646 S 1/2015 Kim
D722,018 S 2/2015 Wang
D728,467 S 5/2015 Hasbrook
D733,043 S 6/2015 Hasbrook et al.
D733,051 S 6/2015 Wang
D740,881 S 10/2015 So et al.
D741,796 S 10/2015 Robinson et al.
2002/0059880 A1 5/2002 Klinefelter et al.
2003/0053109 A1 3/2003 Lester et al.
2004/0090647 A1 5/2004 Beard et al.
2004/0245310 A1 12/2004 Masuda et al.
2005/0156974 A1 7/2005 Silverbrook et al.
2005/0180795 A1 8/2005 Kurashina
2007/0262141 A1 * 11/2007 Ito et al. ..... 235/383
2008/0219692 A1 * 9/2008 Kondo et al. ..... 399/83
2009/0148222 A1 6/2009 Terry et al.

(56) References Cited

U.S. PATENT DOCUMENTS

| | | | | |
|---|---|---|---|---|
| 2013/0155459 | A1* | 6/2013 | Jeong et al. | 358/1.15 |
| 2014/0050961 | A1 | 2/2014 | Enari et al. | |
| 2015/0022611 | A1 | 1/2015 | Taylor et al. | |

FOREIGN PATENT DOCUMENTS

| | | | |
|---|---|---|---|
| EP | 1066969 | A2 | 1/2001 |
| EP | 1849614 | A2 | 10/2007 |
| FR | 2736863 | A1 | 1/1997 |
| FR | 2778141 | A1 | 11/1999 |
| JP | S58128886 | | 8/1984 |
| JP | 1161122 | | 2/1991 |
| JP | 6024627 | | 9/1995 |
| JP | 10149268 | | 12/1999 |
| JP | 10305944 | | 5/2000 |
| JP | 4115979 | B2 | 7/2008 |
| JP | 2011255609 | A | 12/2011 |
| WO | WO-2009071685 | A1 | 6/2009 |
| WO | WO-2015009849 | A1 | 1/2015 |
| WO | WO-2015009860 | A1 | 1/2015 |

OTHER PUBLICATIONS

Coates, J., (Mar. 10, 1996) "AddressMate Plus Produced by CoStar Corp. For . . . ", Software Spotlight, *Chicago Tribune*, (3 pages). Last accessed Feb. 5, 2015 at: <http://articles.chicagotribune.com/1996-03-10/business/9603100068_1_ami-pro-microsoft-word-mailing-labels>.

CoStar Corporation, (1994-1995) "User Manual for AddressMate and AddressMate Plus", AddressMate Plus for Windows User's Manual, (211 pages).

Datamax Corporation, (1999) "Allegro Thermal Printer Maintenance Manual", (162 pages).

Duncan, J., (Jan. 18, 1993), "Windows databases for end-uses", ProQuest, (21 pages).

DYMO, (Apr. 18, 2001) "DYMO's LabelWriter Range Eliminates Label Printing Hassles", (2 pages). Last accessed Jan. 16, 2015 at:<http://global.dymo.com/enCA/PressRelease/DYMO_s_LabelWriter_Range.html>.

DYMO, (May 14, 2001) "DYMO Launches New PC/Mac Connected Product Line", (2 pages). Last accessed Jan. 16, 2015 at:<http://global.dymo.com/enCA/PressRelease/DYMO_Launches_New_PC_Mac_Connected_Product_Line.html>.

DYMO, "Dymo Address Labels White (120130 / 30251)", (3 pages). Last accessed Feb. 15, 2015 at: <http://www.labecity.com/DYMO-address-labels-white-120130.html>.

DYMO, "LabelWriter Address labels", (3 pages). Last accessed Feb. 15, 2015 at: <http://global.dymo.com/enGB/LabelAttribute/LabelWriter_Address_labels.html>.

DYMO, "Standard Tapes", (2 pages). Last accessed Feb. 15, 2015 at: <http://global.dymo.com/enGB/LabelsOverview/Standard_Tapes.html>.

DYMO Corporation, (Mar. 2001) "Declaration of Confirmity," LabelWriter User Manual for LabelWriter Model Nos. 300, 330, 330 Turbo, EL40, EL60 and TUrbo, (56 pages).

Erdman, A., et al., (1991) "Mechanism Design: Analysis and Synthesis—vol. I", *Prentice Hall*, 2nd Edition, (4 pages).

Forderer, S., et al, (1999) "Step by Step Microsoft Office 2000 Self-Study Kit", *Microsoft Press*, Catapult, Perspection and ActiveEduction (9 pages).

Gryphon, R., (Oct. 31, 1994) "Approach 3.0 improves speed, ease of use: Lotus' efforts to optimize indexing bring significant increases in query performance", Reviews, *InfoWorld*, (3 pages).

Heller, Stephen R., (Jun. 10, 1991) "Seiko Smart Label Printer", *Computer Software Reviews*, J. Chem. Inf. Computer Science, vol. 31, No. 3, p. 435.

Hewlett-Packard Co., (Apr. 1999) "HP LaserJet 4000 and 4050 Series Printers Service Manual", (394 pages).

International Search Report and Written Opinion for International Patent Application No. PCT/US2014/046883, mailed Oct. 14, 2014 (10 pages).

International Search Report and Written Opinion for International Patent Application No. PCT/US2014/046901, mailed Oct. 21, 2014 (11 pages).

Intermec Corporation, (Nov. 1997) "3240 Bar Code Label Printer", User's Manual, (178 pages).

Intermec Corporation, (Nov. 1996) "4400 Bar Code Label Printer User's Manual", (318 pages).

Intermec Printer AB, (2002) "Intermec EasyCoder 501 XP Bar Code Label Printer—User's Guide", (178 pages).

Intermec Technologies Corporation, (2000) "LabelShop Ultra & Pro Label Design and Printing Software", Product Profile, (2 pages).

Intermec Technologies Corporation, (Sep. 2000) "Intermec EasyCoder F4 Bar Code Label Printer: Installation & Operation", 3rd Edition, (127 pages).

Karlsson, B., (May 2000) "Thermal Printers", Programmer's Reference Labelpoint II Version 4.3x Copyright Markpoint Printer AB, (79 pages).

Lombardi, J., (Feb. 10, 1992), "Windows Word Processors: InfoWorld Tests the Tools and Features in Six of the High-End Graphical Products", ProQuest, (18 pages).

Marshall, P., (Aug. 22, 1994) "Pulling away from the hard fax", Reviews/Product Comparsion, *InfoWorld*, (12 pages).

Microsoft Corp., (Jun. 7, 1999) "Microsoft Office 2000, an Essential Tool for All Knowledge Workers, Is Available This Week", (4 pages). Last accessed Feb. 5, 2015 at: <http://news.microsoft.com/1999/06/07/microsoft-office-2000-an-essential-tool-for-all-knowledge-workers-is-available-this-week/>.

Rubright, R., (Jan. 24, 1994) "Office Accelerator automates, adds professional polish to correspondence", Reviews/Test Drives, *InfoWorld*, (1 page).

Sato America, Inc., (May 2000) "SATO M-5900RV Direct Thermal Printer: Operator and Technical Reference Manual", (258 pages).

Schwartz, E., (Sep. 14, 1998) "IBM boots PC print management", Client/Server, *InfoWorld*, (1 page).

Stoughton, A., (Dec. 13, 1993) "Q&A flat-file manager moves to Windows: 4.0 features differ from DOS version; offers graphical, quick database query capabilities", Reviews, *InfoWorld*, (4 pages).

Tiplady, B., (1981) "A Basic Program for Constructing a Dispensing List for a Randomised Clinical Trial:", *Letters to the Editors*, Br. J. Clin. Pharmac., vol. 11, pp. 617-618.

Toshiba TEC Corporation, (Nov. 1993) "TEC Thermal Printer B-570 Series Maintenance Manual: Document No. EM18-33010A", (90 pages).

Whipsaw, (Aug. 11, 2014), "Leitz Icon Printer", Last accessed Oct. 5, 2015 at <URL: http://www.whipsaw.com.work/projects/ieitz-icon-printer/>. (4 pages).

YouTube, (Apr. 30, 2014) "Introducing Leitz Icon Smart Labeling System Printer," Last accessed Oct. 6, 2015 at URL: https://www.youtube.com/watch?v=6QVM_bg7LIQ, (1 page).

Brother Corporation, "High-Speed Label Printer with Built-in Ethernet and Wireless Networking," Brother QL-720NW brochure, brother at your side, (4 pages).

Brother Corporation, "Quick Setup Guide," Label Printer QL-710W/720NW, (44 pages).

Brother Corporation, "User's Guide," Label Printer QL-710W/720NW, (23 pages).

U.S. Appl. No. 29/490,326, Printer, filed May 8, 2014.

U.S. Appl. No. 29/490,332, Cartridge for Printer, filed May 8, 2014.

U.S. Appl. No. 29/490,336, Battery Module for Printer, filed May 8, 2014.

U.S. Appl. No. 14/333,259, the Office Actions mailed Mar. 16, 2015 and Jul. 22, 2015.

U.S. Appl. No. 29/490,326, the Office Action mailed Oct. 23, 2015.

U.S. Appl. No. 29/490,332, the Office Action mailed Sep. 17, 2015; and.

U.S. Appl. No. 29/490,336, the Notice of Allowance mailed Nov. 25, 2015.

* cited by examiner

100

LABEL PRINTER

CROSS REFERENCE TO RELATED APPLICATION

This application is filed under 35 U.S.C. §111(a), and claims priority under 35 U.S.C. 119(e) to U.S. Patent Application No. 61/846,926, entitled "Cartridge for Label Printer," filed Jul. 16, 2013, and also claims priority to U.S. Patent Application No. 61/846,931, entitled "Label Printer," filed Jul. 16, 2013, the disclosures of which are incorporated by reference herein in their entirety.

BACKGROUND OF THE DISCLOSURE

1. Field of the Disclosure

The embodiments disclosed herein relate to printer devices, and in particular to printers useful for printing continuous stock such as labels.

2. Description of the Related Art

There are a myriad of applications where it is desirable to efficiently, routinely and inexpensively label items. For example, in a medical setting, personnel print labels on a daily basis for new medical records and for updating old medical records. Without providing additional examples, it suffices to note that there is an enormous demand for quality labeling systems. Various printing systems are described, for example, in U.S. Pat. Nos. 6,890,113, 6,857,801, 6,835,013, 6,812,943 and 6,503,005, which are incorporated by reference herein in their entireties for any purpose whatsoever.

Accordingly, a number of specialized label printers have been developed and are commercially available. Generally, such label printers are efficient and reliable but not without expense. For example, many of these label printers make use of expensive cartridges for containing and dispensing labels. Quite often, such cartridges dispense only a single form of labeling media, and versatile use requires maintaining an extensive library of cartridges.

What are needed are methods and apparatus to provide improved printing systems for printing continuous media, such as rolls of labels. Preferably, the systems provide for reliable printing, are inexpensive to manufacture and distribute, and offer a reduced environmental impact over the prior art.

SUMMARY OF THE DISCLOSURE

In one embodiment, a label printer is provided. The label printer includes a receiving area configured for receiving a cartridge including a roll of media, the receiving area including at least one feature for aligning a media guide of the cartridge as well as a cradle with a channel for aligning a body of the cartridge with a printing mechanism; and components configured for adjusting sizing of the media to provide virtual label sizes.

In another embodiment, a label printer is provided. The label printer includes a receiving area configured for receiving a cartridge including a roll of media, the receiving area comprising at least one feature for aligning a media guide of the cartridge as well as a cradle with a channel for aligning a body of the cartridge with a printing mechanism; and a processor configured for executing machine executable instructions stored on a non-transitory source, the instructions configured for adjusting label sizing to provide a virtual label size.

In a further embodiment, a system for printing labels is provided. The system includes a label printer comprising a receiving area configured for receiving a cartridge including a roll of media for printing labels thereon, a receiving area configured for receiving a cartridge comprising a roll of media, the receiving area including at least one feature for aligning a media guide of the cartridge as well as a cradle with a channel for aligning a body of the cartridge with a printing mechanism, the printer further including a processor configured for executing machine executable instructions stored on a non-transitory source, the instructions configured for adjusting label sizing to provide a virtual label size; and a remote computing device configured for interfacing with the printer.

BRIEF DESCRIPTION OF THE DRAWINGS

The features and advantages of the disclosed embodiments are apparent from the following description taken in conjunction with the accompanying drawings in which.

DETAILED DESCRIPTION OF THE DISCLOSURE

Figure 1:
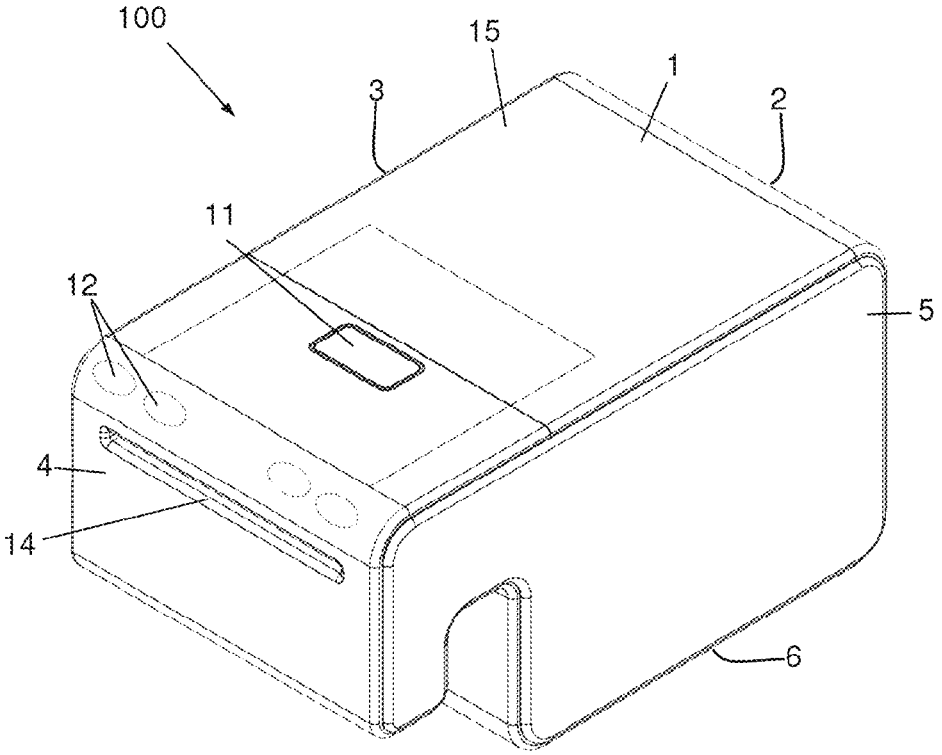
FIGS. 1 through 3 are perspective views of an exemplary printer.

Disclosed herein is a printer for printing labels from media stored on in a media cartridge. The media cartridge is of a particular design and may be made of recyclable materials. A wide variety of media may be used in the printer, and a wide variety of printing capabilities are provided. Generally, the printing solutions provided herein offer a compact, low cost system with diverse capabilities.

Aspects of the media cartridge are presented herein, and are further disclosed in U.S. Patent Application No. 61/846,926, entitled "Cartridge for Label Printer," filed Jul. 16, 2013, as well as the non-provisional application claiming priority thereto, both of which are incorporated by reference herein in their entirety.

In some embodiments, the media can be continuous form roll media, while in some other embodiments, the media can be provided as a roll of die-cut labels. A printing system according to the teachings herein exhibits a variety of advantageous features. Among other things, a printer and cartridge designed for the printer provide for automatic loading of label media; automatic retraction of label media; software adjustment of printing parameters to provide for virtual label sizing; automatic detection of cartridge status; advanced cartridge latching mechanism to ensure alignment of media; and an advanced feed mechanism that prevents bunching of media. A variety of cartridges may be used with the printer. Advantageously, the cartridges include a body that may be formed at least partially of low cost, recyclable material.

In order to provide some context, some terms are now introduced. As discussed herein, the term "printer control unit" (also referred to as "PCU") generally refers to components of the printer that are useful for controlling functionality and operation of the printer. The term "thermal print head"

(also referred to as "TPH") generally refers to a component that transfers images onto media, printing one raster line of dots at a time. As discussed herein, the term "die-cut" generally refers to a type of media in which individual labels have been cut by a die to create multiple, labels disposed on or into a roll of underlying material. The term "continuous" generally refers to a type of media that does not have predefined or die-cut patterns in it. Embodiments of die-cut labels may include, for example, labels that are separately formed and then applied to the underlying media, as well as labels that are at least partially cut from the media is itself (e.g., portions of the media can be defined by a perimeter of perforations or score lines or cuts provided in advance). Embodiments of continuous media may include forms of media where the printing process will define boundaries or dimensions of a given label.

As used herein, "web width" generally refers to a width of a roll of media; "cardstock" generally refers to a non-adhesive media material used for binder inserts, tags, appointment cards, and similar items (cardstock may also be referred to as "tag stock," and by other similar terms). Generally, the term "form length" refers to a length of a respective label from a top edge to bottom edge of the label. As discussed herein, the term "steps" generally refers to increments of a stepping motor (not shown) for advancing or retracting the media. As is known in the art, the term "dot" is with reference to resolution of the print head, and therefore the printer, and may further be used to describe dimensions (and in particular dimensions or relations with regards to the media). As discussed herein, the roll may be interchangeably referred to as a "spool."

As discussed herein, the term "virtual label" generally refers to software determinations regarding a label. As discussed herein, the term "virtual label" generally refers to a cut-to-size label that is derived from a continuous roll of media based on specific software determinations and substitutions provided by the printer. For example, a virtual label may be plotted onto a continuous roll of media, and have boundaries that are determined according to calculations and other properties, such as resulting cut lines. Providing virtual labels calls for comparing user inputs and requirements to loaded media, as well as other available media.

Reference to "paper handling" and other similar terms should generally be construed as references to the media, unless otherwise noted. Generally, the term "paper path" refers to a path of print media from a media cartridge in a forward direction and from an exit slot of the printer.

Referring now to FIG. 1, there is shown an exemplary label printer 100. The label printer 100 may be used to print labels having a wide range of characteristics. For example, the label printer 100 may print labels having a variety of substrate materials (e.g., labels may be formed of paper, plastic, film, foil, any other substrate material deemed appropriate and may be provided as combinations of the foregoing). The label printer may print labels having a variety of sizes (e.g., such any size from a variety of standard sizes used in office work, and may include specialty sizes for custom applications).

In the exemplary embodiments, the label printer 100 is deployed as a desktop printer. In some embodiments, the label printer 100 is a hand-held unit, or takes on a different form or appearance. The label printer 100 may be provided as a printer having a diverse set of printing capabilities for printing continuous form media provided as a roll of stock and dispensed from a cartridge.

In embodiments discussed herein, the label printer 100 uses thermal printing technology. However, the label printer 100 may make use of any type of printing technology deemed appropriate.

Generally, the label printer 100 includes at least user interface (not shown). Exemplary user interfaces include at least one keypad and/or display on the label printer 100, and may further include a network interface and a local interface. In some embodiments, the user interface includes two buttons, and two LED's used to convey status information, while interfacing with the label printer 100 is predominantly accomplished via a browser on a remote computing device in communication with the label printer 100. Exemplary protocols that may be used by the label printer 100 for communications include, without limitation, Ethernet, Universal-Serial-Bus (USB), serial, parallel, wireless (for example, wifi (802.11), Bluetooth and/or others) and the like.

Additional components that may be included are at least one of a processor, memory (including read-only-memory (ROM), random-access-memory (RAM, including non-volatile RAM, or NVRAM) and other forms or designations of memory), data storage, a power supply, a clock, and the like. The power supply may include a source of alternating current (AC) and/or direct current (DC). DC may be supplied by a transformer and/or battery. Firmware may be included in embodiments of read-only-memory (ROM), or in another form as determined appropriate. Generally, the firmware includes a machine readable instruction set for processing by the processor. The instruction set may include a substantial set of instructions for governing communication with and operation of the printer 100 via the processor.

In addition, the printer 100 may be governed, at least in part, by instruction sets provided as software. Software may be implemented in a diverse architecture. For example, the software may include a user interface that may be implemented on a personal computer, and the personal computer may communicate with the printer 100 through a communications network. A portion of the software may be loaded into the printer (such as into the ROM) and adapted for receiving communications from the personal computer. In one example, software may include various components, such as "drivers" which integrate the software with a particular computing environment and may perform a variety of low level tasks. Reference to "drivers" and other particular components are merely illustrative of techniques for implementing software, and are not limiting of the teachings herein. Whether instructions are provided through firmware or software, the instructions include machine executable instructions provided as a non-transitory signal, such as instructions stored in non-transient machine readable media, and provide, at least in part, for implementation of a given method. Software may be implemented by processors (whether remote or on-board), controllers, microcontrollers, and other similar devices. Accordingly, the terms "processor," "controller," "microcontroller" and other similar terms, are generally considered interchangeable for purposes herein.

The label printer 100 may be configured to communicate with a remote computing device (not shown). Exemplary remote computing devices include desktop computers, tablets, mobile stations such as a smartphone and other such devices. A remote computing device may be configured with a software application (or "client") that is configured for interfacing with the label printer 100.

As the label printer 100 has substantial on-board capabilities, clients operated on remote systems may be relatively simple. That is, a remote client may be operable on a system with relatively little processing power (such as with a hand-held computer, such as a smartphone). Accordingly, in some embodiments, the label printer 100 is configured for recognizing and processing a command that includes limited information. For example, the label printer 100 may be configured to receive an instruction that is limited to content (i.e., text and/or imagery), formatting requirements, and a specified label identifier. The label printer 100 will then process the information with on-board processing (for example, by implementation of instruction sets), and appropriately manage printing on die-cut labels, continuous media and virtual labels as appropriate.

In the exemplary embodiment, the label printer 100 is generally cubic in appearance. That is, the label printer 100 includes a top 1, a backside 2, a first side 3, a front 4, an opposing side 5 and a bottom 6. In this example, the label printer 100 may include a distinctive appearance that includes a unique shape (as discussed further herein). Dimensions may be varied as deemed appropriate.

Certain relational or geometric terminology is used herein to aid in a description of the label printer 100. Generally, this terminology makes reference to the foregoing view of the label printer 100. However, such terminology is merely for purposes of discussion, and is not to be construed as limiting of the label printer 100.

The label printer 100 may include a control panel 12. The control panel 12 permits a user to control certain functions of the label printer 100. Additionally, functions of the label printer 100 may be at least partially controlled remotely (as discussed further herein). The label printer 100 includes an exit slot 14. The exit slot 14 provides output of printed labels.

Generally, the exterior of the label printer 100 includes a door latch that includes a latch button 11. Depressing the latch button 11 permits user to open lid 15.

Figure 2:
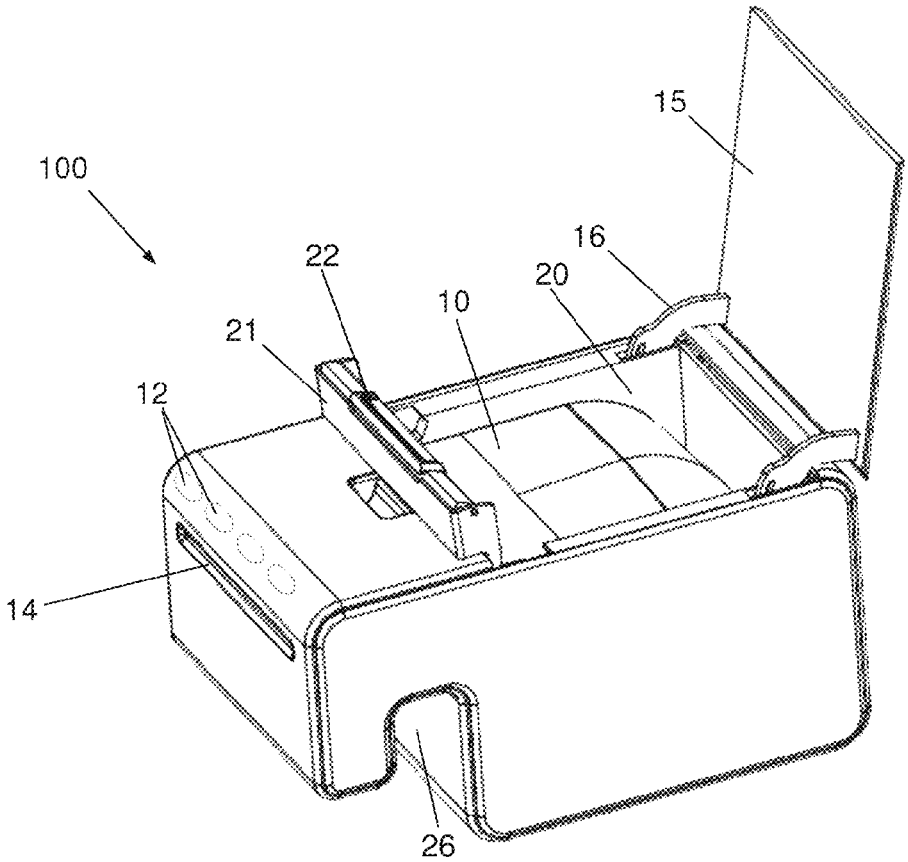

Refer now also to FIG. 2 where the label printer 100 is shown in an open configuration. In this example, the latch button 11 has been depressed and the hinged lid 15 is in an open position. Generally, opening the lid 15 merely calls for lifting a front portion of the lid 15 and rotating the front portion of the lid 15 toward the backside 2 about hinge 16.

Once the lid 15 has been lifted to the open position, locking bar 21 may be similarly rotated into a forward position. Locking bar 21 may be unlatched from the label printer 100 by releasing bar latch 22.

Disposed within receiving area 20 of the label printer 100 is a cartridge 10. Generally, the receiving area 20 is configured to mate with surface features disposed on a variety of embodiments of the cartridge 10. The surface features ensure alignment of each cartridge 10 (and therefore the media contained within the cartridge 10) with a printing mechanism of the label printer 100.

The label printer 100 may include a saddle area 26. Generally, the saddle area 26 includes an overhang which provide a convenient handle for portability of the label printer 100.

Figure 3:
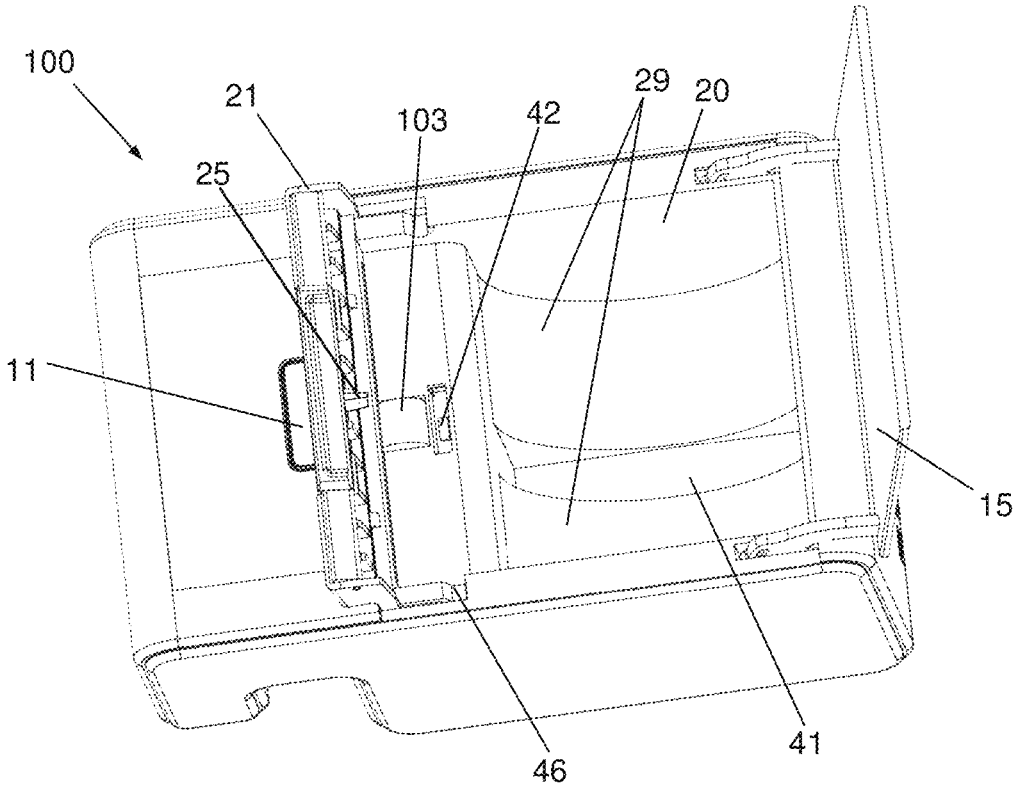

Refer now also to FIG. 3, where a top-down view of the label printer 100 without the cartridge 10 is shown. In this embodiment, the receiving area 20 includes channel 41. Channel 41 is configured for receiving a keel of the cartridge 10. In this embodiment, the channel 41 generally extends from the backside 2 to a forward side of the receiving area 20, and is centrally disposed between the first side 3 and the opposing side 5.

Disposed on each side of the channel 41 is a cradle 29. Each portion of the cradle 29 is generally configured or shaped to receive and retain a base of the cartridge 10. Each portion of the cradle 29 provides physical support to a body of the cartridge 10, thus ensuring good retention of the cartridge 10.

The channel 41 and the cradle 29 may be arranged in any manner deemed appropriate. For example, more than one channel 41 may be provided. More specifically, and as an example, another channel (not shown) may be disposed parallel to the centrally disposed channel 41. The another channel may be sized for receiving a respective rib (not shown) on the base of the cartridge 10. In some other embodiments, the another channel may be disposed parallel to an axis of media rotation, thus intersecting with the centrally disposed channel 41.

A chip reader 42 is also shown. Chip reader 42 provide for interfacing with the cartridge 10. More specifically, and by way of example only, chip reader 42 may include electrical contacts to provide for interfacing with an NVRAM circuit (or "chip") disposed on the cartridge 10. In some embodiments, chip reader 42 includes a radio-frequency-identification (RFID) antenna. Also shown in FIG. 3, is a feed roller 103. Generally, the feed roller 103 provides for feeding of media from the cartridge 10 into the label printer 100.

The label printer 100 may include additional features for securing the cartridge 10. For example, locking bar 21 may include alignment tab 25. Alignment tab 25 will ensure alignment of the cartridge 10 by mating with a slot on the dispenser thereof. Additionally, the label printer 100 may include at least one bay 46 for receiving a respective side tab disposed on the dispenser of the cartridge 10.

Figure 4:
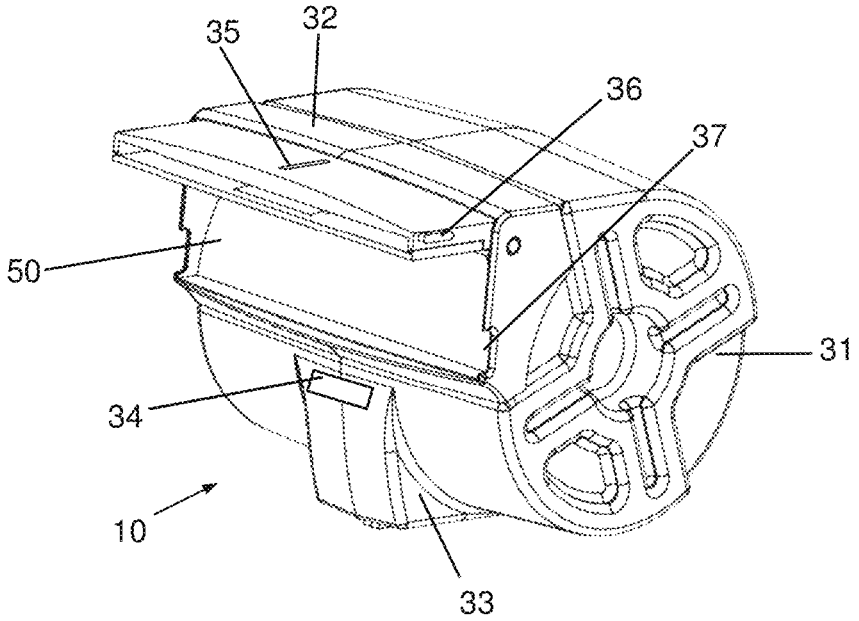
FIG. 4 is a perspective view of a media cartridge for the printer of FIGS. 1 through 3.

Referring to FIG. 4, an exemplary embodiment of the cartridge 10 is shown. In this example, the cartridge 10 includes a body 31 and a dispenser 32. Disposed within the body 31 is a spool of labels, also referred to as a "roll 50." The roll 50 may be pulled from the cartridge 10 through the dispenser 32 by the label printer 100 as needed.

In the exemplary embodiment, the cartridge 10 includes a keel 33. Generally, the keel 33 of any respective cartridge 10 is commonly sized (i.e., a standard size). Generally, the keel 33 is configured to mate with the receiving area 20 of the label printer 100 and provides for stability and a secure fit of each cartridge 10 when the cartridge 10 is disposed within the label printer 100. Disposed on each side of the keel 33 is base 39. Generally, the base 39 is a lower portion of the body 31 and may exhibit a semi-circular shape. Other shapes and surface features may be included in the base 39.

Generally, the base 39 and the keel 33 of any given cartridge 10 are designed to fit snugly within the channel 41 and on the cradle 29.

Accordingly, although a single printer 100 may be configured for using cartridges of various sizes, each cartridge 10 that is loaded into the printer 100 can be installed in an appropriate geometry (such as centrally aligned) within the printer 100. The cartridge 10 may also include an electronic circuit (referred to herein as chip 34), such as a non-volatile random-access-memory (NVRAM), and/or other similar components as well as suitable combinations thereof. Accordingly, the label printer 100 may be configured to recognize each cartridge 10 by communicating with the respective chip 34. Once recognition has been performed, the label printer 100 may adjust internal parameters, communicate recognition information, and perform other similar functions. In some embodiments, the label printer 100 is configured to store data in the chip 34. Data stored may include information such as a number of labels from the cartridge 10.

In some embodiments, the cartridge 10 may be referred as incorporating a one-piece clamshell design made of recyclable material. The clamshell surrounds and supports the roll and a dispenser for feeding media to the printer 100.

Communication between the printer 100 and the chip 34 may be, at least in part, encrypted. Accordingly, the printer 100 and the associated cartridges may be substantially tamper-proof.

Further, the cartridge 10 may include slot 35. Generally, at least one slot 35 is configured to mate with a respective alignment tab 25 disposed on locking bar 21. Additionally, cartridge 10 may include at least one side tab 36. Generally, at least one side tab 36 is configured to mate with a respective bay 46 in the receiving area 20. When the cartridge 10 is not disposed in the printer 100, the side tab 36 is securely mate with tab receiver 37. For example, side tab 36 may snap into tab receiver 37, by virtue of a slightly constricted geometry, use of cam style hinge in the dispenser 32 and by other similar designs.

Generally, the locking bar 21 provides a locking mechanism. That is, the locking bar 21 swings down on top of the dispenser 32 to secure the cartridge 10 into the printer 100. In some embodiments, the locking bar 21 has a cam surface that releases pressure between the print head and platen roller when in the unlocked position. This allows easy removal of media in an unpowered situation where the printer did not auto-unload the media back into the cartridge 10.

Generally, the channel 41, the at least one alignment tab 25, the at least one side tab, (and the corresponding features on the cartridge) as well as the locking bar 21, ensure that the cartridge 10 is aligned with the printer mechanism and that the cartridge 10 is well secured within the printer 100.

The cartridge 10 may be configured to dispense media of varying widths. In some embodiments, narrow media is provided in the cartridge 10, which is in turn configured internally with spacers and other such devices to ensure alignment of the media with the printer 100. In other embodiments, the cartridge 10 is narrower than the width of the receiving area 20. Accordingly, in some of these latter embodiments, the cartridge 10 may be disposed in the receiving area 20 without the benefit of the side tabs (or at least one of the side tabs).

Figure 5:
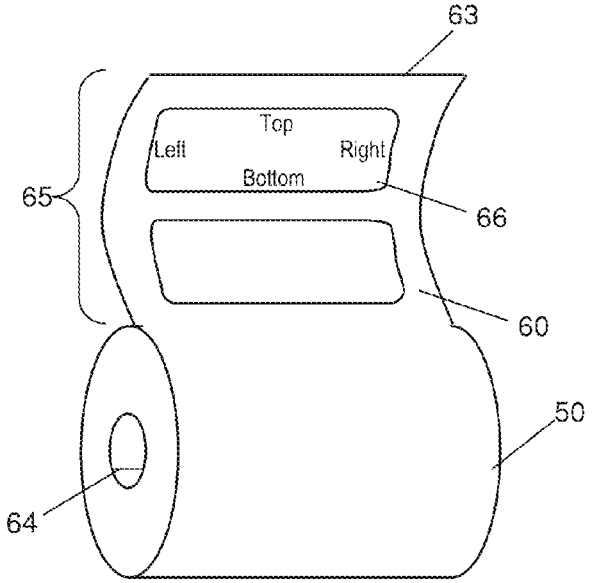
FIG. 5 is an illustration of a die-cut labels disposed on a roll of labels.

Referring to FIG. 5, an exemplary supply of media 60 is shown. In this example, roll 50 is shown separated from a body of the cartridge 10 (merely for purposes of illustration). The roll 50 provides for a plurality of labels 66. A portion of the media 60 is rolled off of the roll 50 to provide a leader 65. Generally, the leader 65 facilitates loading and feeding of the media 60 into the label printer 100. The leader 65 includes leading edge 63 which signifies a beginning of the media 60 (a trailing edge 64 is opposite to the leading edge 63 and at an end of the media 60). As a matter of convention herein, each label 66 includes a top side, a bottom side, a left side and a right side.

Figure 6:
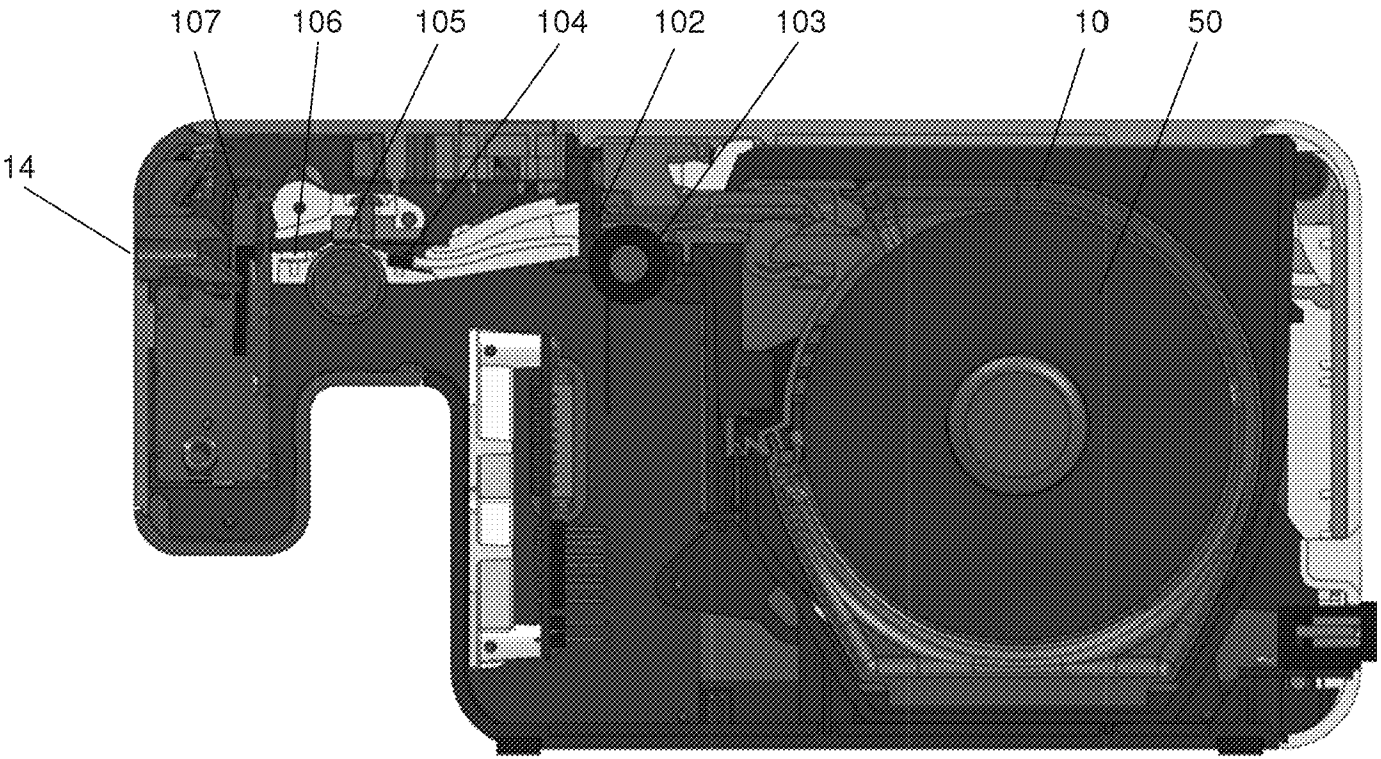
FIG. 6 is a cutaway side-view of the printer of FIGS. 1 through 3.

Referring now to FIG. 6, there is shown a cut-away side view of an exemplary embodiment of the label printer 100 of FIGS. 1 through 3. Disposed within the printer 100 is the cartridge 10 which includes the roll 50. Also shown is a label guide 102, feed roller 103, a pre-platen optical sensor 104, a print head 105 which is located at a print line, a post-platen optical sensor 106, a cutting blade 107 and an exit slot 14. In some embodiments, the printer 100 may include additional pre-platen or post-platen sensors, and may eliminate at least some of these optical sensors, depending on the desired functionality or other criteria.

Various other components as are known in the art may be included, and are not shown, including but not limited to features illustrated and described in patents incorporated by reference herein above.

In some embodiments, the printer 100 will impose a minimum physical top margin of fifteen steps (about 0.05" or 1.27 mm). This facilitates pre-loading of the media 60 under the thermal print head 105, and positioning with the print line. The firmware in the printer is responsible for insuring that the leading edge 63 of the media 60 is pre-loaded into this position on initial loading, and retracted to this position after cutting. In addition, the firmware can impose a similar margin of fifteen steps on the left and right sides of the loaded media 60. A bottom margin (to match the others) may be imposed by software, for example, through printer drivers.

Figure 7:
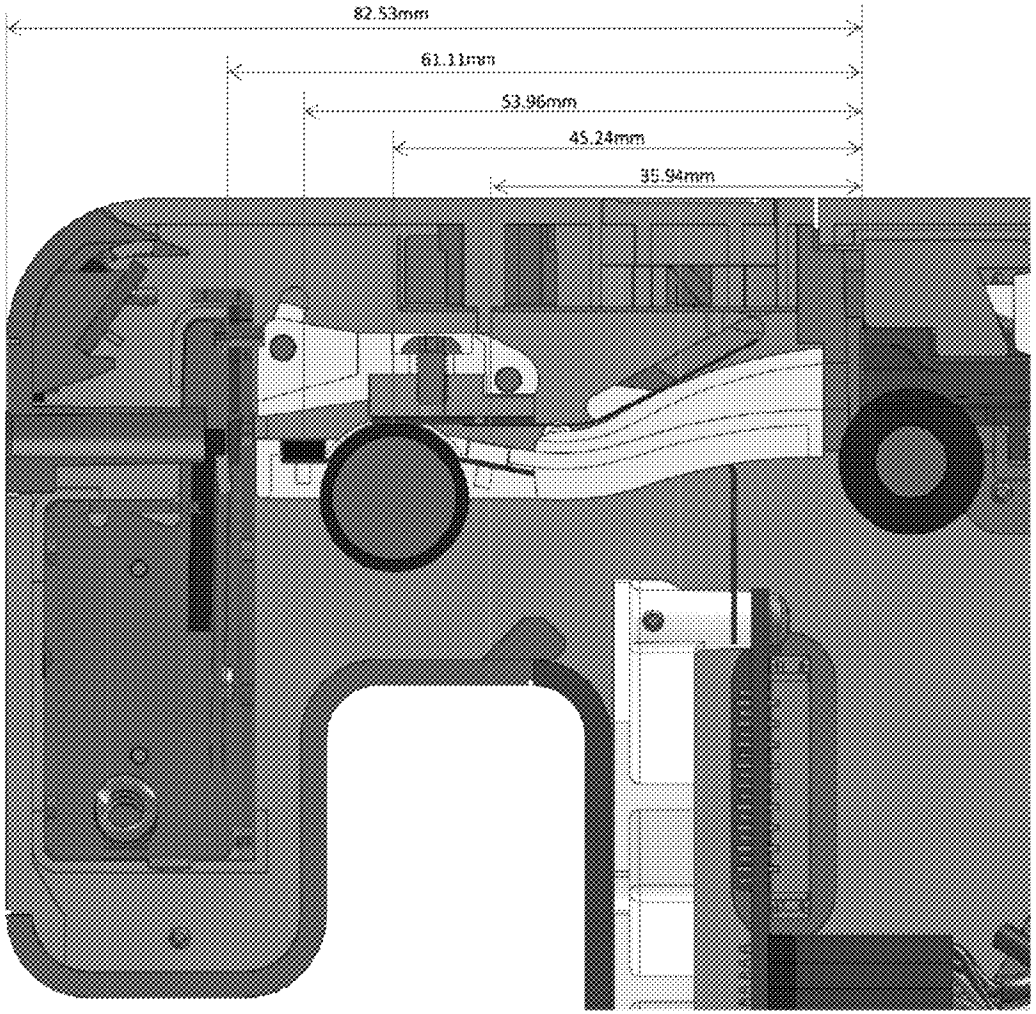
FIG. 7 is a cutaway side view of the printer of FIGS. 1 through 3 and 6, depicting some dimensional relationships.

Physical characteristics of the printer 100 determine much of the behavior for handling of the media 60. Dimensions within the printer 100 and relative to an exit from the label guide 102 are provided in Table I, below. Aspects of the printer 100 as introduced herein may be provided with reference to dimensions of the exemplary embodiment. It should be recognized that these dimensions are merely illustrative, and are not limiting of the teachings disclosed herein. Further, reference may be had to FIG. 7 which provides an illustration of the information in Table I.

TABLE I

Exemplary Internal Printer Dimensions

| Distance to: | Distance (mm) | No. of steps (Approximate) |
|---|---|---|
| Pre-platen optical sensor | 35.94 | 424 |
| Raster print line | 45.24 | 534 |
| Post-platen optical sensor | 53.96 | 637 |
| Cutting Blade | 61.11 | 722 |
| Label Exit slot | 82.53 | 1010 |

In some embodiments, firmware is responsible for controlling handling of the media 60, including loading of the media 60, imaging, cutting, recognizing jammed conditions or empty conditions, and other similar functions. Additionally, the firmware may be tasked with communicating with chip 34 to track and report media type, size, supply level, and validating that it is official media, and the like. In some embodiments, the chip 34 is provided with encryption and authentication features.

In some embodiments, specific details such as the type of media 60 will be communicated via any one or more of particular protocols such as ESC commands (when using USB), AirPrint's IPP standards, and SNMP. Communications protocols may vary substantially, and be determined by a system designer, manufacturer, or other similarly interested party.

Generally, the printer 100 is rich with features that provide for versatile printing. Aspects of exemplary features are now presented. However, it should be recognized that additional embodiments of the features as well as additional features may be provided. Among other things, the printer has a variety of features for: printer state inputs; loading paper; unloading paper; out of paper detection; form feeding; controlling continuous label form-feed behavior; controlling continuous label leaders and trailers; managing raster line printing; performing printer self tests and diagnostics.

Printer state inputs. The printer 100 has several input/output (I/O) controls used for reporting the printer state. These include: Door Switch, chip 34 (NVRAM), pre-platen and post-platen optical sensors; paper feed button; and a cut button. Aspects of each are now introduced.

With regard to printer state inputs, the door switch control may be used to recognize when the door is opened or closed. The paper loading process commences when the printer door is closed, as detected by the door switch. The chip 34 may be provided as a crypto-authentication memory device built into each cartridge 10. When a respective cartridge 10 is loaded, the processor of the printer 100 may read data from the chip 34 as well as write data to the chip 34. Besides crypto-authentication, the chip 34 provides information regarding the media 60 as well as a number of labels 66 used from the roll 50. In the case of continuous media, the chip 34 may record and communicate length of media used in inches, millimeters or other suitable units. Optical sensors may be used in the printer 100 to detect the absence or presence of the media 60, orientation of the media 60 and any control markings on the media (such as top-of-form (TOF) markings and timing markings). Exemplary optical sensors include the pre-platen optical sensor and the post-platen optical sensor. In some embodiments, the sensors admit infrared (IR) light and detector reflection of the emitted light. Generally, any control markings used on the media 60 will appear as non-reflective markings and indicate a no-paper present signal. Accordingly, the printer 100 may be configured (such as in the firmware) to account for dynamics present when control markings are used. In some embodiments, a paper feed button (not shown) is included. The paper feed button may be included in a convenient location, such as on a front panel of the printer 100. Generally, the paper feed button is provided to advance the media 60. If die-cut labels are loaded, actuation feeds the media to the next top-of-form (TOF) position. If continuous media is loaded and if the media 60 is stopped at a print line position, actuation will feed an appropriate length of the media 60. For example, actuation may feed media up to and just shy of the exit slot 14. The paper feed button may be tasked with context-sensitive functions, such as with other appropriate functions during a printer self-test. Actuation of a cut button (not shown) activates the cutting blade 107. Generally, actuation of the cut button provides for a single cutting sequence. Since die-cut media 60 may be positioned with the top-of-form (TOF) position just beyond the print line, when die-cut media is loaded, and the cut button is actuated, the printer 100 will advance the die-cut media 60 appropriately. For example, the printer 100 will advance the media 60 such that a printed portion of the label 66 is clear of a cutting position in which the media 60 is to be cut. Advancement may account for the geometries of the particular labels, as well as inter-label spacing. Subsequently, the printer 100 will activate the cutting blade 107 and then retract the media 60 an appropriate amount. If the cut button is actuated when continuous form media 60 is loaded into the printer 100, the printer 100 will feed additional media 60, activate the cutting blade 107 and retract the media 60 an appropriate amount.

Loading media 60 into printer 100. The printer 100 simplifies loading of the media when a door of the printer 100 is closed. Loading actions then depend on a type of media 60 (continuous form or die-cut media) that has been inserted into the printer 100. Aspects of loading media 60 into the printer 100 are now introduced.

In some embodiments, when the printer 100 detects closing of the lid 15, a load paper process will start. Generally, the load paper process begins with accessing the chip 34 disposed on the cartridge 10. The chip 34 may include crypto-authentication. If the printer 100 does not detect the chip 34, then logic (such as in the firmware) may conclude that the lid 15 was closed without the cartridge 10. Otherwise, the logic may then proceed with authentication of the media 60, and then further determining a type of the media 60. Type determination may include determining whether the media 60 is continuous form, die-cut form, a spacing of labels 66 on the media 60, a number of labels used from the roll 50 and other similar aspects. If there are no labels 66 on the roll 50, or the media 60 type is not recognized, the printer 100 may be configured to stall further operation.

In some embodiments, when the cartridge 10 is loaded into the printer 100, the Printer Control Unit (PCU) reads the chip 34 on the cartridge 10. The starting count of labels 66 for the roll 50, as well as the number used to date is read from the chip 34. If the PCU determines that the cartridge 10 is not empty, the PCU will command the printer to automatically start feeding the labels through the mechanism, stopping at the print position. The PCU may write data to the chip 34, such as when the cartridge becomes empty, in order to indicate that the cartridge 10 is empty and prevent reuse of the cartridge.

Generally, the printer 100 will load the media 60 in a manner that depends on the type of media 60. For example, for continuous form media 60, in one embodiment, the leading edge of the media 60 is to be fed 15 steps (0.05" or 1.27 mm) beyond the print line of the print head. Printer drivers may be configured to assume this built-in margin. Generally, the firmware is configured to recognize the true leading edge of the media 60, even if the leading edge is at a point where a black TOF mark starts. For this reason a secondary, off-center optical sensor may be disposed adjacent to the primary pre-platen optical sensor. This secondary sensor may be positioned such that it will not be able to sense the black registration marks, and will therefore only detect the true leading edge of the media 60.

Use of die-cut media may present certain issues upon loading. For example, a potential issue with die-cut media 60 is that the media 60 may have been cut between labels 66, or a cut may have occurred in the middle of a die-cut label 66. Accordingly, in some embodiments, the printer is configured to advance past any partial label 66 that is at the beginning of the roll 50, and stop feeding when the first full label 66 is positioned and ready for printing with 15 steps (0.05" or 1.27 mm) of the label extending beyond the print head's print line.

If the label was preceded by a partial label that was greater than 31 mm (370 steps) the minimum allowed label length, then after finding the TOF of the first whole label, the printer will advance the media, cut off the partial label, and then retract back to the starting print position.

An additional embodiment involving loading of the cartridge is now provided. In this example, to load a cartridge 10, the user first flips the rotating label guide (not shown) on the cartridge 10 to the up/open position. The cartridge 10 is placed into the printer 100, where a large rib in the cartridge 10 provides for alignment of the cartridge 10 with the printer 100, and smaller features such as a plastic rib on the bottom side of the rotating label guide provides fine alignment. Once the cartridge 10 is in place within the printer 100, a cartridge latch (not shown) is flipped down, securing the cartridge 10 and compressing the cartridge brake (not shown) against the feed roller. The media 60 is now ready to feed out of the cartridge 10.

When the user closes the printer lid 15, a detect switch may be tripped and the printer 100 goes through an auto-load process. Rollers feed the media 60 forward until the first label 66 is at TOF. This may be determined, for example, by the optical sensors. The feed roller 103 and the platen roller are directly geared together, so they rotate at the same angular rate. If both rollers were designed with the same nominal diameter, then with tolerances there could be cases where the feed roller was slightly larger than the platen roller. This would cause it to feed the media slightly faster than the platen roller, leading to bunching of media between the two rollers.

In some embodiments, in order to prevent bunching of media between the two rollers, the feed roller diameter is nominally slightly undersized compared to the platen roller. This causes it to feed media at a slightly slower speed than the platen roller. Since the platen roller has much higher preload than the feed roller, the media is pulled tight and the feed roller slips a little bit, causing the paper position and feeding speed to be driven by the platen roller. In some embodiments, differential roller durometers are used to encourage higher grip by the platen roller than the feed roller.

Generally, there are two rollers driven by a single motor via a gear train. The first, the feed roller 103, is closest to the cartridge 10 and is used for initial feeding of the media into the printer 100. The second, the platen roller, is used to drive the media once the media is properly loaded. The platen roller may be disposed opposite to the thermal print head (TPH).

In some embodiments, during loading, the leading edge of the labels is first picked up by the feed roller 103. The feed roller 103 is oriented such that is in contact with the underside of the media and opposing a leaf spring disposed within a throat of the dispenser 32. The feed roller 103 then feeds the media into the printer 100. As the leading edge of the media approaches the platen roller, the platen will engage with the media and it too will start to pull the media. In this instance, one would normally have an issue where two rollers are both feeding media, driven off the same motor, but with tolerances that could lead to either one of the rollers driving a tiny bit faster due to a difference in diameters. This could lead to a stretching of the media, or worse, bunching of the media between the two rollers. To address this problem, the printer may incorporate a design with so that the platen roller is slightly larger than the initial feed roller. In addition, the preload force of the feed roller can be lower than the platen roller, so the feed roller will slip rather than the platen roller. These slight differences mean that once engaged, the platen roller will become the "feeder" for the media, with the feed roller providing a small amount of drag to keep the paper from bunching.

In some embodiments, once the media 60 has been properly loaded, the printer 100 will switch to a ready state.

Unloading media. Unloading of media 60 begins when the printer 100 recognizes that the door to the printer 100 has been opened. In some embodiments, the printer 100 will be taken off-line (for example, by terminating any communications and performing other similar reconfigurations), and then reverse the stepper motor so as to unload labels from the printer 100. Generally, there are three possibilities for the state of the media 60 in the printer 100 when the unloading sequence starts. First, the media 60 may be positioned at a print position (i.e., at the print head 105). In terms of dimensions for the exemplary embodiment, this is with the leading edge disposed 1.27 mm beyond the print line. Second, the media may be extending beyond the print line by more than 1.27 mm, and may further be extending beyond the cutting blade 107 or the exit slot 14. In a third possibility, dispensing of the media may have stopped prior to the print head 105 as a result of for example a paper jam or for having run out of media. A further state may occur where the printer is actively printing when a user opens the door. Different steps may be taken for handling of each condition. Exemplary embodiments for addressing each condition are provided.

In the case where the media 60 is at the print position, the printer firmware may reverse the stepper motor and drive for 550 steps (1.833" or 46.56 mm) to retract the labels to the front edge of the cartridge label guide 102. In the case where the media 60 is beyond print position (where for the exemplary set of printer dimensions) the media 60 extends 10 mm or more beyond the exit slot 14, then the cutting blade 107 may be activated to minimize the amount of material to be taken up. The printer 100 may then reverse feed and retract the media 722 steps, even for media 60 that did not extend beyond the exit slot 14. For cases where the media 60 is disposed prior to the print position, which should only occur if the printer ran out of media while loading a roll, or due to a paper jam, one of two things may occur. If the printer 100 is out of paper, then the media 60 will be retracted a suitable number of steps (such as 524 steps). Otherwise, if the pre-platen sensor detected paper, it will retract a second number of steps (such as 424 steps). If paper appears to be prior to the pre-platen optical sensor, it will not be retracted, leaving the user to "fish it out."

In cases where the printer is printing and the user opens the lid 15, the printer will complete the label being printed. When printer commands are received that indicate that the current label has completed printing, the printer 100 will cut the label, and unload the media, if printing a die-cut label. At the same time, the printer 100 will enter a state where the rest of the print job is ignored or otherwise not acted upon.

If the media is continuous, then the printer will stop where it is, feed out enough media so that at least 10 mm is extending beyond the exit slot (or other suitable distance), and then cut the label, and unload the media. At the same time, the printer will enter a state where the rest of the print job is ignored or otherwise not acted upon.

Out of paper detection. In some embodiments, in order to maintain operation of the printer within design constraints, the trailing edge of the media 60 is prevented from going through the printer 100. For this reason, each roll 50 of media will have a printed "end-of-roll" (EOR) identifier printed across the entire width of the media 60. In some embodiments, the EOR identifier is disposed approximately six inches prior to the trailing edge of the roll 50. Each EOR identifier may be identified by use of, for example, a secondary, off-center optical sensor that is disposed prior to the platen. If the EOL identifier is identified during printing, then printing may be immediately stopped, or terminated after completion of a given print task, while preserving an adequate supply of media 60 within the printer 100.

In some embodiments, when an out of paper condition is detected, the printer 100 will report "paper out" status. Additionally, if printing was in progress, and the leading edge of the media 60 extends more than 10 mm beyond the exit slot, then the printer 100 will automatically cut the media 60 and retract the media 60 to the initial print position, thereby setting the printer 100 up for a paper unload event.

Form feeds. In some embodiments, there are two types of form feed commands supported by the printer 100. The two types of form feed commands include a "short form feed," and a "long form feed." The short form feed command is useful for feeding media 60 between labels 66, such as when a series of labels is being printed. The long form feed command is useful after any single-label print job, and at the end of a multi-label print job. The behavior of these two commands is dependent on various factors including, for example, the type of media loaded (die-cut vs. continuous).

Die-cut label form feed behavior. Upon receipt of a long form feed command (for example, ESC, e), the printer 100 will feed the label 66 being printed so that the gap between respective labels 66 is positioned at the cutting blade 107. The printer 100 will then cycle the cutting blade 107 to cut the media 60 and finally retract the media 14.56 mm (172 steps) to position the next label 66 in printing position. In some embodiments, every print job will send a long form feed as part of the end of job processing.

The short form feed command (ESC, G), is generally only used between labels during a multi-label print job. In some embodiments, the short form feed command will not actuate the cutting blade 107 to cut the media 60 between respective labels 66. When the short form feed command is received, the printer 100 will advance the media 60 to the proper print position for printing of the next label 66. The result will be a continuous length of die cut labels 66, cut by the long form feed command, which may be employed to end a given print job.

Continuous label form feed behavior. Upon receipt of a long form feed command (for example, ESC, e), the printer 100 will feed the exact distance from the print line of the print head 105 to the cutting blade 107 (188 dots). The cutting blade 107 will cut the media, and the printer 100 will retract the media 60 by 173 dots (=188-15) to leave the media 60 at the TOF/starting print position, setting the printer 100 in a condition ready for printing of the next label 66.

The short form feed command (ESC, G), is generally only used between labels during a multi-label print job. For continuous media, upon receipt of the short form feed command, the printer 100 will respond by feeding 15 steps, leaving the printer 100 ready to print the next label 66 (at a top-of-form (TOF)/starting print position). The printer 100 will then receive data for the next label 66, repeating this flow until the last label 66 has been printed. If desired, software may print Cut-Lines to visually indicate the boundary between adjacent labels prior to issuance of the short form feed command.

Figure 9:
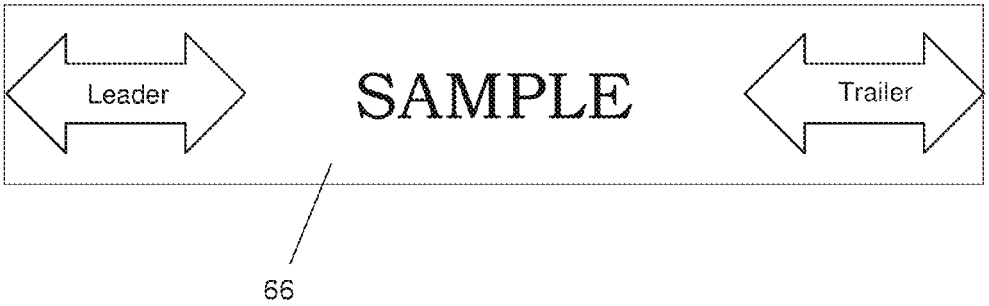

Continuous label leaders and trailers. As shown in FIG. 9, a label 66 printed on continuous form media 60 may have leading blank space and trailing blank space. Aspects of a leader (at the beginning of the label 66) and a trailer (at the end of the label 66) may be controlled through software settings, which may be communicated to the printer 100 by drivers. In some embodiments, a minimum length for each one of the leader in the trailer is 5 mm, with a default of 8 mm. In some embodiments, the printer 100 will automatically lengthen the trailer if the overall length of the label 66 (i.e., a length of the leader, the printed data in the trailer) is less than a predetermined dimension (e.g., about 35 mm). This is to insure that there is enough media 60 sticking out of the exit slot 14 for the user to grasp the printed label 66.

Drivers will have printer-specific options to increase or decrease the Leader and Trailer when printing Continuous Tape labels. A printer command that skips a desired number of print lines will allow adding the necessary number of blank raster lines at the beginning or end of a label.

Raster line printing. In some embodiments, because labels are generally center fed into the printer 100, except for the widest of the media, there will be an offset from the left edge of the print head 105 when printing. This offset will be handled by the firmware automatically offsetting the label, including the 15 dot (0.05" or 1.27 mm) margin, if such a margin is provided automatically by the printer.

Similarly, the printer 100 may calculate the bytes/line value based on the width of the loaded media 60. Therefore, software drivers will also adjust the bytes per line (BPL) value based on the loaded media 60.

In order to insure proper operation, the printer 100 is capable of returning an expected number of bytes per line. This can be done by a printer command that returns an appropriate number of bytes of data required to form a print line for the loaded media size. Alternatively, a value for an expected number of bytes per line may be returned in response to a printer "Get Status" or "Get Cartridge Information" command. Exemplary calculations and some conventions are now provided:

Media Width "MW." Data stored in the NVRAM may provide, among other things, the printable media width, excluding any liner margins, in dots. So, a die-cut label that is exactly 2" wide has a printable media width of 600 dots in the case of a 300 dot per inch print head.

Print Head Width "PHW." Other than the detail above, each raster line is printed by a combination of "Transfer Print Data," and "Transfer Compressed Print Data" commands. The print head width (PHW) is 960 dots wide.

Margin. Margins may nominally be set to 15 dots each side of the label 66.

Dots Per Line "DPL." Generally, the DPL equals MW−(2*Margin). For example, a two inch wide label has MW=600, and DPL=600−(2*15)=570 dots.

Bytes per Line "BPL." Generally, the BPL equals truncf ((DPL+7)/8). For example, a two inch wide label with DPL=570: (570+7)/8=72.125. The integer portion of this is 72, and therefore 72 BPL.

It should be noted that the foregoing calculations provide merely one embodiment for calculating certain printing parameters.

NVRAM/Crypto-Authentication Management. As noted above, each cartridge 10 may include an electronic component (chip 34) such as non-volatile random-access memory (NVRAM). Generally, it is the responsibility of the printer firmware to query and update the Crypto-Authentication NVRAM chip 34 in any given cartridge 10. This may include verifying the authenticity of the cartridge 10 when loaded or at power on.

Additionally, the firmware may be configured to respond to queries from the application software, drivers, or additional software applications regarding, by way of example: type of media loaded (die-cut or continuous); media inventory information from common retailer inventory schemes (i.e., determine an SKU number); media sensitivity (dependent on material); roll capacity (in inches or number of labels); media used (in inches or number of labels); width of labels in various units used by the printer units such as dots, inches, and Bytes per Line (BPL); length of media in printer units (or identification of a value indicating continuous media) and other similar quantities.

In some embodiments the printer 100 is configured so that during operation, the printer 100 will give an error if it detects a cartridge 10 that is not authorized. The printer 100 may also be configured to update the media used after a label is printed or material is ejected from the printer using the feed button. Control of the print head may be adjusted based on the media sensitivity value set in the NVRAM prior to printing.

In some embodiments, such as to prevent "reloading" of cartridges, the printer may be configured to set an unalterable indicator in the Crypto Memory Device to permanently indicate that the cartridge is empty upon detecting that a cartridge has become empty.

The printer 100 offers a great deal of versatility to users, in part, as a result of complementing software applications used to control the printer 100. Software applications used to control the printer 100 may be provided for a variety of computing environments. Computing environments may include, for example, Windows (available from Microsoft Corporation of Redmond Wash.), and the Macintosh or iOS environments provided by Apple Corporation of Cupertino Calif., as well as many others.

Applications may be configured to communicate with the printer 100 using an appropriate printer driver (Mac or Windows), or via Apple AirPrint or other suitable means. This section will address features and functions that useful for implementing drivers, printing via AirPrint, as well as special paper handling choices that may be made in the applications themselves.

Advantageously, the printer 100 provides the ability to use a single, continuous roll of adhesive media for multiple label sizes, reducing the need to change labels, and providing more utility to users sharing the device over a network. Additionally, since one continuous roll of media can substitute for several individual sizes, users need not have multiple rolls of media in different sizes to keep track of. This means, for example, that a user is able to select a standard address label template, and print it either on die-cut address labels, or appropriately sized continuous media. In order to allow substitution of one label type with another, compatible label type, the drivers are provided with capability for mapping from one paper size to an equivalent paper size, in effect, making a number of the supported paper sizes "virtual paper sizes."

In order to provide some context for application controls, aspects of processes and additional terminology are now introduced. Generally, each print job includes the following phases: "Begin Job" at the beginning of a print job, the printer will select the paper, initialize the printer for printing, and perform other similar function; "Begin Page" occurs just before actual transfer of raster data to the printer. During this phase, initialization specific to the label itself is performed; "Data Transfer" is where imaging data is sent to the printer; "End Page" finishes the page printing. If the page printing does not include the last label in the print job, the printer 100 may print a Cut-Line, before performing other necessary cleanup tasks. Form feeds (short or long) may be a part of this process; and "End Job" sends the commands necessary to end a print job.

The End Page phase may be followed by an End Job, as above, or another series of Begin Page, Data Transfer, End Page, repetitively in the case of multiple labels.

The various types of media may be named. In some embodiments, there are two types of names. A first name includes a name that is used within the printer (e.g., an internal code), and a second name may be provided as a user recognizable name.

Figure 8:
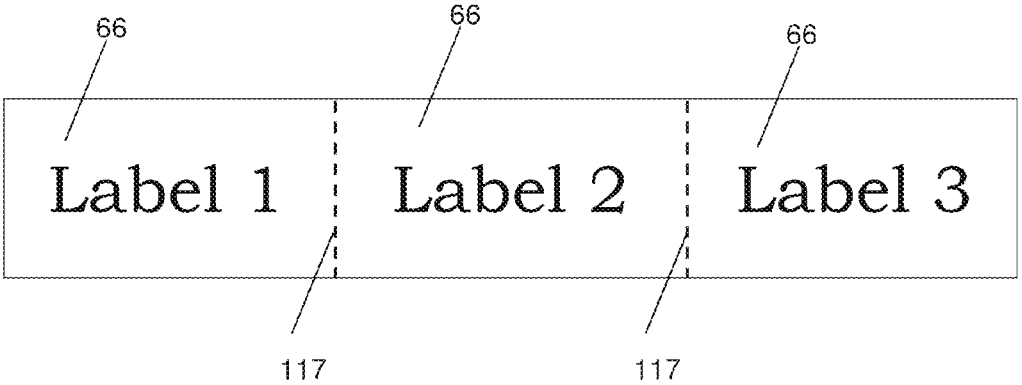
FIG. 8 depicts three labels disposed on continuous form media, with cut-lines provided; and, FIG. 9 is an illustration of a continuous form label.

The software may be provided with a number of options. In some embodiments, the software prints cut-lines or performs cutting between the labels 66. Reference may be had to FIG. 8. In FIG. 8, a plurality of labels 66 are shown disposed on continuous form media. Between the labels 66 are cut-lines 117. The cut-lines 117 may be printed by the printer 100 during printing of the labels 66. Accordingly, a user may subsequently divide the labels 66 at their convenience. Use of the cut-lines 117 or printer initiated cutting may be provided as a user selectable option.

Generally, this option is available when printing multiple labels using virtual paper sizes or continuous labels. Additionally, this option may be limited to behavior between a group of labels. Generally, if the print cut-lines 117 option is selected, then the software will transfer data for printing a dashed line. In one embodiment, the dashed line is made up of one raster line of alternating series of 15 on pixels and 15 off pixels. The dashed line may be printed between each virtual or continuous label. Once the series of labels has been printed, the printer 100 will then send a short form feed command to advance to print position for the next label. If cut between labels is selected, then the printer 100 may send a long form feed command to cause the just printed label to be cut.

Another option provides for setting the length of each one of the leader and the trailer for a given label 66 (see FIG. 9). Generally, these two options allow the user to include an additional margin at the start and the end of the continuous label. The additional margin is provided in the form of blank raster lines that result in blank areas at the beginning and the end of a given label.

Virtual paper sizes may be provided in the software. In some embodiments, substitution of paper size equivalents occurs at the driver level. Paper sizes and the driver will include the die-cut version of paper sizes. Accordingly, and by way of example, templates for address labels may be developed on the standard address label definition paper size, and the application will then select this size in the print job when setting up the media for printing.

When a print job starts, the software may query the printer to determine the type of media that is loaded. It may be considered that there are three possible outcomes resulting from this query.

In a first outcome, if the media type is an exact match for the paper size requested, the software will continue with the print process. This will be the case for die-cut media that matches the paper in the template being printed, as well as the case when a continuous label is being printed in a width matching the width of the continuous media cartridge that is loaded.

In the next possible outcome, the media is not a compatible continuous media. If the media requested has a virtual equivalent, but the media loaded is not of the required type, then the printer will generate an error the results in the print job being canceled, or it may be paused and provide notification to a user to permit change of media types.

In the next possible outcome, it is determined that the loaded media is the continuous equivalent of a requested media (a virtual paper). If the loaded media can substitute for the requested die-cut media, the software will determine the virtual paper height in raster print lines. The software will also determine if the label needs to be rotated. The software will then place the printer in any continuous paper mode and then send the necessary print data including any adjustments in margins, skipping of lines, and the like as necessary. The software will then transfer end of page or end of job commands to advance the label or cut the label as appropriate.

Table II provides exemplary virtual paper size mapping.

TABLE II

Virtual Paper Size Mapping

| | | | Compatible Tape Cartridge To Use | | | | |
|---|---|---|---|---|---|---|---|
| Label | Width | Height | A1: 0.5 | A2: 0.75 | A3: 1.0 | C1: 2.0 | D1: 3.54 |
| Multi-Purpose | 0.50 | 1.88 | X* | | | | |
| Return address label | 0.75 | 2.00 | | X* | | | |
| Multi-Purpose | 0.75 | 2.50 | | X | | | |
| Multi-Purpose | 1.00 | 1.00 | | | X* | | |
| Multi-Purpose | 1.00 | 1.50 | | | X* | | |
| Return address label, Intl. | 2.12 | 1.00 | | | X* | | |
| Suspension file label | 0.50 | 2.00 | X* | | | | |
| Name badge label | 2.00 | 3.00 | | | | X | |
| Name badge label | 2.33 | 3.46 | | | | | X |

TABLE II-continued

| Virtual Paper Size Mapping | | | | | | | |
|---|---|---|---|---|---|---|---|
| | | | Compatible Tape Cartridge To Use | | | | |
| Label | Width | Height | A1: 0.5 | A2: 0.75 | A3: 1.0 | C1: 2.0 | D1: 3.54 |
| File folder labels | 0.66 | 3.46 | | | | | X |
| Standard address label | 1.10 | 3.46 | | | | | X |
| Large address label | 1.41 | 3.46 | | | | | X |
| Shipping label, small | 2.33 | 3.46 | | | | | X |
| Compliance shipping label | 6.00 | 3.46 | | | | | X |

X* Label is rotated on printing

Various other components may be included and called upon for providing for aspects of the teachings herein. For example, it is to be understood that although conventional components of a printer have not been disclosed herein, such components may be included (as a matter of necessity, or as an election by designers manufacturers or in other similarly interested party). More specifically, it is to be understood that the printer may include, for example, at least one roller, motor, gear, drive, transmission, power supply, circuit, power connector and other similar components beyond those described herein. Additional components or materials, as well as combinations of components and materials and/or omission of components and materials may be used to provide for added embodiments that are within the scope of the teachings herein.

Further, it should be recognized that particular aspects of software disclosed herein are merely illustrative and are not limiting. For example, escape sequences or escape codes merely imply control codes that are transferred to the printer for controlling the printer. It is not intended that this disclosure provide a complete listing of control codes or control protocols, but merely illustrate examples where appropriate.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure has been described with reference to exemplary embodiments, it will be understood by those skilled in the art that various changes may be made and equivalents may be substituted for elements thereof without departing from the scope of the disclosure. Any committal statements (such as "must have," "is" and other similar statements) are merely with reference to the specific embodiment, and are not limiting of the teachings herein. Many modifications will be appreciated by those skilled in the art to adapt a particular instrument, situation or material to the teachings of the disclosure without departing from the essential scope thereof. Therefore, it is intended that the disclosure not be limited to the particular embodiments disclosed but those described by the appended claims.

What is claimed is:

1. A label printer, comprising:

a receiving area configured for receiving a cartridge comprising a roll of media, the receiving area comprising at least one feature for aligning a media guide of the cartridge as well as a cradle with a channel for aligning a body of the cartridge with a printing mechanism; and a moveable locking bar for retaining the media guide of the cartridge in the receiving area, the locking bar comprising at least one alignment feature disposed thereon for mating the locking bar with a corresponding alignment feature disposed on the media guide.

2. The label printer as in claim 1, wherein the cartridge comprises a body comprising a keel and a base configured to align with the cradle.

3. The label printer as in claim 1, wherein the locking bar comprises at least one alignment tab for mating with a slot disposed on the media guide.

4. The label printer as in claim 1, further comprising a saddle area disposed in a body of the label printer.

5. The label printer as in claim 1, further comprising a chip reader for communicating with a chip disposed on the cartridge.

6. The label printer as in claim 5, wherein the chip reader comprises at least one of a pair of electrical contacts and a radio-frequency-identification (RFID) antenna.

7. The label printer as in claim 5, wherein the chip reader is configured for at least partially encrypted communication with the chip.

8. The label printer as in claim 1, wherein the media comprises one of die-cut media and continuous form media.

9. The label printer as in claim 1, wherein the printing mechanism comprises a thermal printing head.

10. The label printer as in claim 1, further comprising at least one of a power supply, a clock, a user interface and a network interface.

11. The label printer as in claim 1, further comprising at least one sensor for sensing a position of the media.

12. The label printer as in claim 11, wherein the at least one sensor is configured to provide sense information to a printer control unit (PCU).

13. The label printer as in claim 1, further comprising a feed roller and a platen roller, the rollers adapted for advancing the media.

14. The label printer as in claim 13, wherein the feed roller is configured to at least one of: provide drag on the platen roller; and, to slip before the platen roller slips.

15. The label printer as in claim 1, wherein the locking bar rotates between an unlocked position and a locking position to align the media guide of the cartridge with the printing mechanism.

16. The label printer as in claim 1, wherein the receiving area is configured to separately receive cartridges of various sizes and align respective bodies of the variously sized cartridges with the printing mechanism.

17. The label printer as in claim 1, further comprising components configured for adjusting sizing of the media to provide virtual label sizes.

18. The label printer as in claim 17, wherein the components comprise machine executable instructions stored on machine readable media, the instructions comprising instructions for controlling the adjusting.

19. The label printer as in claim 17, wherein the components comprise at least one of firmware, a processor, memory and data storage.

20. A label printer comprising:

a receiving area configured for receiving a cartridge comprising a roll of media, the receiving area comprising at least one feature for aligning a media guide of the cartridge as well as a cradle with a channel for aligning a body of the cartridge with a printing mechanism; and a moveable locking bar for retaining the media guide of the cartridge in the receiving area, wherein the receiving area is configured to separately receive cartridges of various sizes and align respective bodies of the variously sized cartridges with the printing mechanism.

21. The label printer as in claim 20, further comprising a processor configured for executing machine executable instructions stored on a non-transitory source.

22. The label printer as in claim 20, wherein the locking bar comprises at least one alignment tab for mating with a slot disposed on the media guide.

23. The label printer as in claim 20, further comprising a saddle area disposed in a body of the label printer.

24. The label printer as in claim 21, wherein the processor is configured for receiving user input.

25. The label printer as in claim 21, wherein the processor is configured for stepping a motor driving one of a platen roller and a feed roller.

26. The label printer as in claim 21, wherein the processor is configured for encrypted communication with a circuit disposed on the cartridge.

27. The label printer as in claim 21, wherein the processor is configured for at least one of controlling loading of the media; controlling unloading the media; controlling cutting functions; receiving input from at least one sensor; detecting presence of the media; detecting a type of the media; and, adjusting printing according to a type of the media.

28. The label printer as in claim 21, wherein the instructions are configured for adjusting label sizing to provide a virtual label size.

29. A system for printing labels, the system comprising:

a label printer comprising a receiving area configured for receiving a cartridge comprising a roll of media, the receiving area comprising at least one feature for aligning a media guide of the cartridge as well as a cradle with a channel for aligning a body of the cartridge with a printing mechanism, the printer further comprising a moveable locking bar for retaining the media guide of the cartridge in the receiving area, the locking bar comprising at least one alignment feature disposed thereon for mating the locking bar with a corresponding alignment feature disposed on the media guide; and a remote computing device configured for interfacing with the printer.

30. The system as in claim 29, wherein the remote computing device comprises one of a desktop computer, a tablet, a mobile station and a smartphone.

31. The system as in claim 29, wherein the remote computing device comprises a client configured for interfacing with the label printer.

32. The system as in claim 29, wherein the label printer further comprises a processor configured for executing machine executable instructions stored on a non-transitory source, the instructions configured for adjusting label sizing to provide a virtual label size.

33. A system for printing labels, the system comprising:

a label printer comprising a receiving area configured for receiving a cartridge comprising a roll of media, the receiving area comprising at least one feature for aligning a media guide of the cartridge as well as a cradle with a channel for aligning a body of the cartridge with a printing mechanism, the printer further comprising a moveable locking bar for retaining the media guide of the cartridge in the receiving area, wherein the receiving area is configured to separately receive cartridges of various sizes and align respective bodies of the variously sized cartridges with the printing mechanism; and a remote computing device configured for interfacing with the printer.

34. The system as in claim 33, wherein the remote computing device comprises one of a desktop computer, a tablet, a mobile station and a smartphone.

35. The system as in claim 33, wherein the remote computing device comprises a client configured for interfacing with the label printer.

* * * * *